US005954339A

United States Patent [19]

Yiu

[11] Patent Number: 5,954,339

[45] Date of Patent: Sep. 21, 1999

[54] DART GAME HAVING AN AUTOMATIC PLAYER

[76] Inventor: Chih-Hao Yiu, 6F-2, No. 160, Chung-Kang Road, Sec. 1, Taichung, Taiwan

[21] Appl. No.: 09/050,140

[22] Filed: Mar. 30, 1998

[51] Int. Cl.[6] ..... F41J 3/02

[52] U.S. Cl. ..... 273/408; 273/371

[58] Field of Search ..... 273/371, 408

[56] References Cited

U.S. PATENT DOCUMENTS

| | | | |
|---|---|---|---|
| 4,768,789 | 9/1988 | Clark | 273/371 |
| 5,553,861 | 9/1996 | Pan | 273/371 |
| 5,755,443 | 5/1998 | Huang | 273/371 |

*Primary Examiner*—William H. Grieb
*Attorney, Agent, or Firm*—Charles E. Baxley

[57] ABSTRACT

A dart game includes a dart board havng a number of dart segments slidably engaged in the score area for being shot by a dart and by one or more users. One or more sensing membranes are disposed behind the dart segments for detecting the shot of the dart onto the dart segments. One or more displayers may be used for displaying the scores shot by the users. A processing device may be actuated as an antomatic player in order to generate an automatic score in competing with the score of the dart segments shot by the user and for playing with the user. The playing capability of the processing means may be predetermined for generating the automatic score corresponding to that of the user. The automatic score is preferably randomly generated.

4 Claims, 4 Drawing Sheets

DART GAME HAVING AN AUTOMATIC PLAYER

BACKGROUND OF THE INVENTION

1. Field of the Invention

The present invention relates to a dart game, and more particularly to a dart game having an automatic player.

2. Description of the Prior Art

Typical dart games comprise a dart board having a number of dart segments to be shot by one or more users. The processing units and the displayers of the dart game may calculate and show the scores of one or more players. However, when only one user plays the dart game and when no other players may play with the user, the user may feel boring for shooting the darts by himself.

The present invention has arisen to mitigate and/or obviate the afore-described disadvantages of the conventional dart games.

SUMMARY OF THE INVENTION

The primary objective of the present invention is to provide a dart game having a processing unit that may randomly generate a competing score for simulating a player to play with the user.

In accordance with one aspect of the invention, there is provided a dart game comprising a dart board including a score area and a number of dart segments slidably engaged in the score area for being shot by a dart and by a user, the dart segments each representing a predetermined score, means for detecting a shot of the dart segments shot by the dart, means for displaying a score of the dart segments shot by the dart, and processing means for generating an automatic score in competing with the score of the dart segments shot by the dart.

A game selecting means may be provided for selecting a game to be played with. The playing capability of the processing means may be predetermined for generating the automatic score corresponding to the capability of the user. The automatic score is preferably randomly generated.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
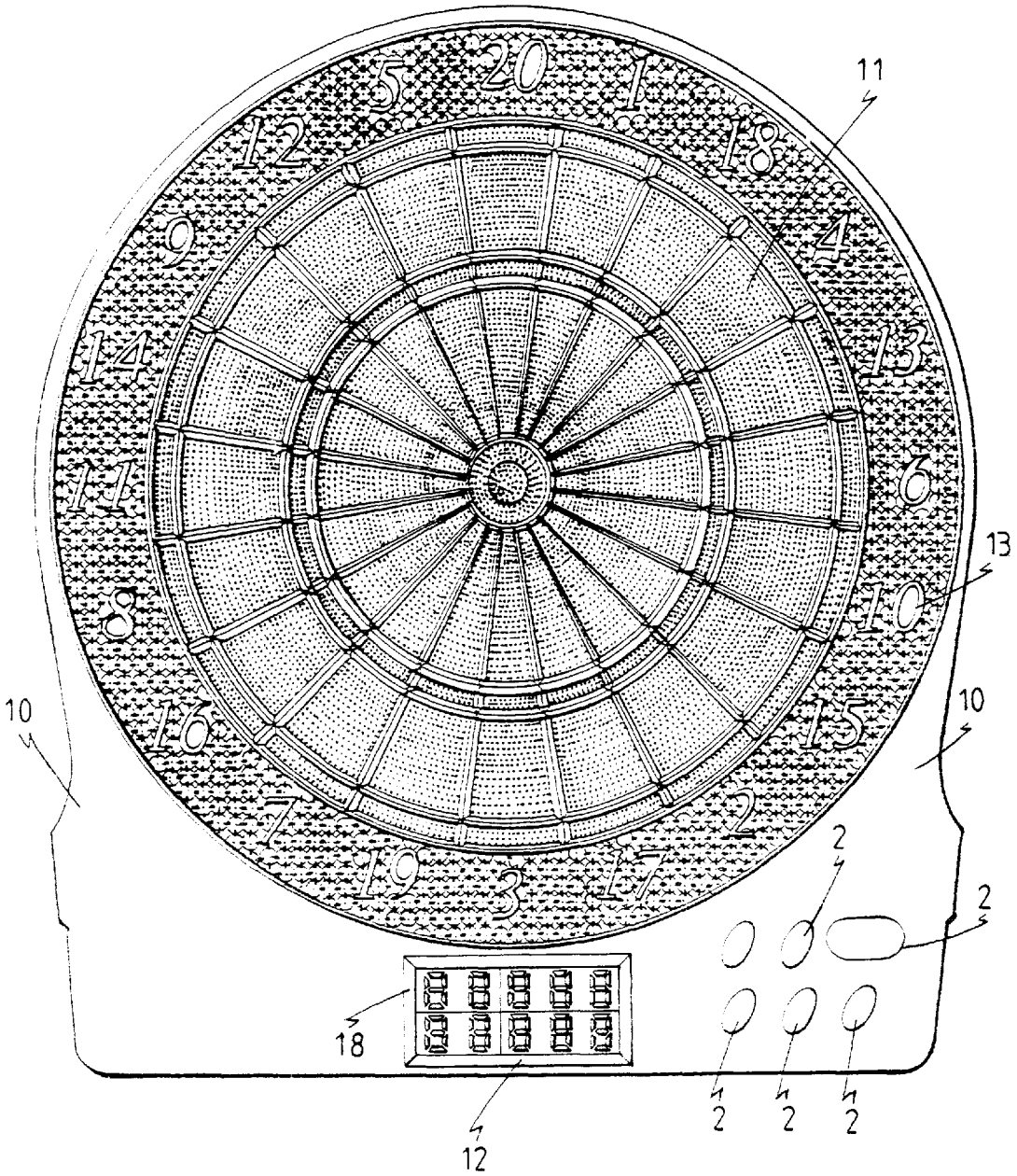
FIG. 1 is a front elevational view of a dart game in accordance with the present invention.
Figure 2:
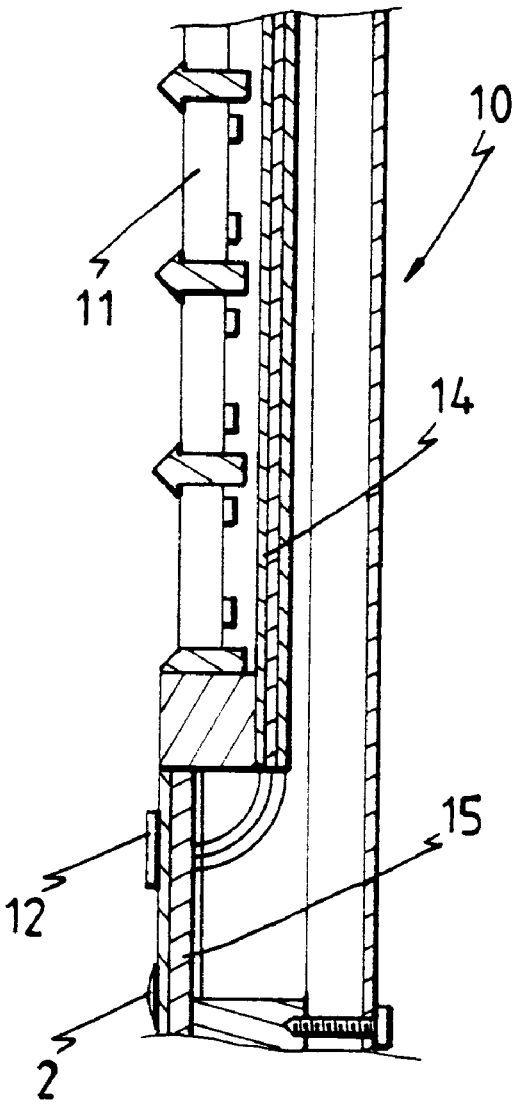
FIG. 2 is a partial cross sectional view of the dart game.
Figure 3:
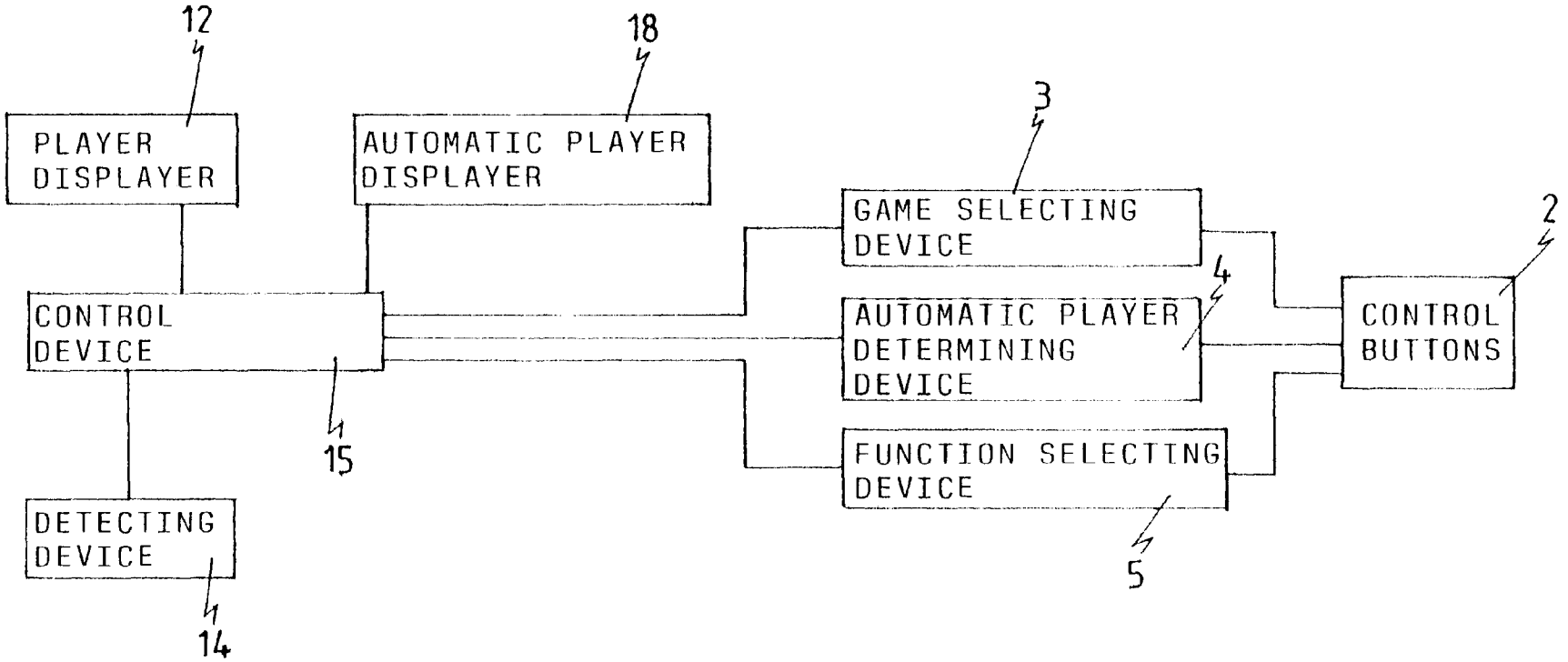
FIG. 3 is a block diagram illustrating the elements of the dart game.

Referring to the drawings, and initially to FIGS. 1–3, a dart game in accordance with the present invention comprises a dart board 10 including a front portion having a number of dart segments 11 slidably engaged in the score area and having a number of numericals 13 provided around the dart segments 11 for showing the scores of the corresponding dart segments 11. One or more displayers 12, 18 are provided in the lower portion of the dart board 10 for displaying the scores of one or more players. A detecting device 14 includes one or more sensing membranes disposed behind the dart segments 11 (FIG. 2) for detecting the shot of the dart onto the dart segments 11. A control device 15 includes a processing unit coupled to the detecting device 14 for determining the scores of the shots and for displaying the scores in the displayers 12, 18. The control device 15 itself may also be a computer or a processing unit. A number of control buttons 2 are provided in the lower portion of the dart board 10 for controlling the operation of the dart game.

As shown in FIG. 3, a game selecting device 3, an antomatic player determining device 4 and a function selecting device 5 are coupled between the control device 15 and the control buttons 2 for allowing the control buttons 2 to actuate the devices 3, 4, 5 respectively. The game selecting device 3 may be actuated to selected the game to be played with. The games include such as count down, 301, 401, cricket, etc., for example. The antomatic player determining device 4 may be actuated, by depressing one of the buttons 2, when an automatic player is required. The automatic player determining device 4 may or may not be actuated when two or more players may play with the dart game. The function selecting device 5 may also by actuated by one of the buttons 2 to determine the grade or the playing ability of the automatic player. For example, when the user is an excellent dart shooter, the user may actuate the function selecting device 5 to select an automatic player having a better corresponding grade or playing ability for the dart game. When the user is a beginner, the user may choose to select a worse or lower grade or playing ability for the automatic player by depressing one of the control buttons 2. The displayer 12 may be used for displaying the score of the user, and the other displayer 18 may be used for displaying the score of the automatic player, for example. Alternatively, a single displayer 12 or 18 may be used for displaying the scores of the players alternatively.

The control device 15 may be actuated by the automatic player determining device 4 in order to randomly generate one or more competing scores corresponding to the shots of the player when the antomatic player determining device 4 is actuated by depressing one of the buttons 2, and in order to act as the autmoatic player. For example, when the user (person) shoots three shots, the user may obtain three scores for the three shots. The control device may randomly generate three scores corresponding to the three shots of the user when the user finishes his three shots. In order to distinguish between the person (user) who plays with the automatic player (computer), the person is named as the user in the specification.

Figure 4:
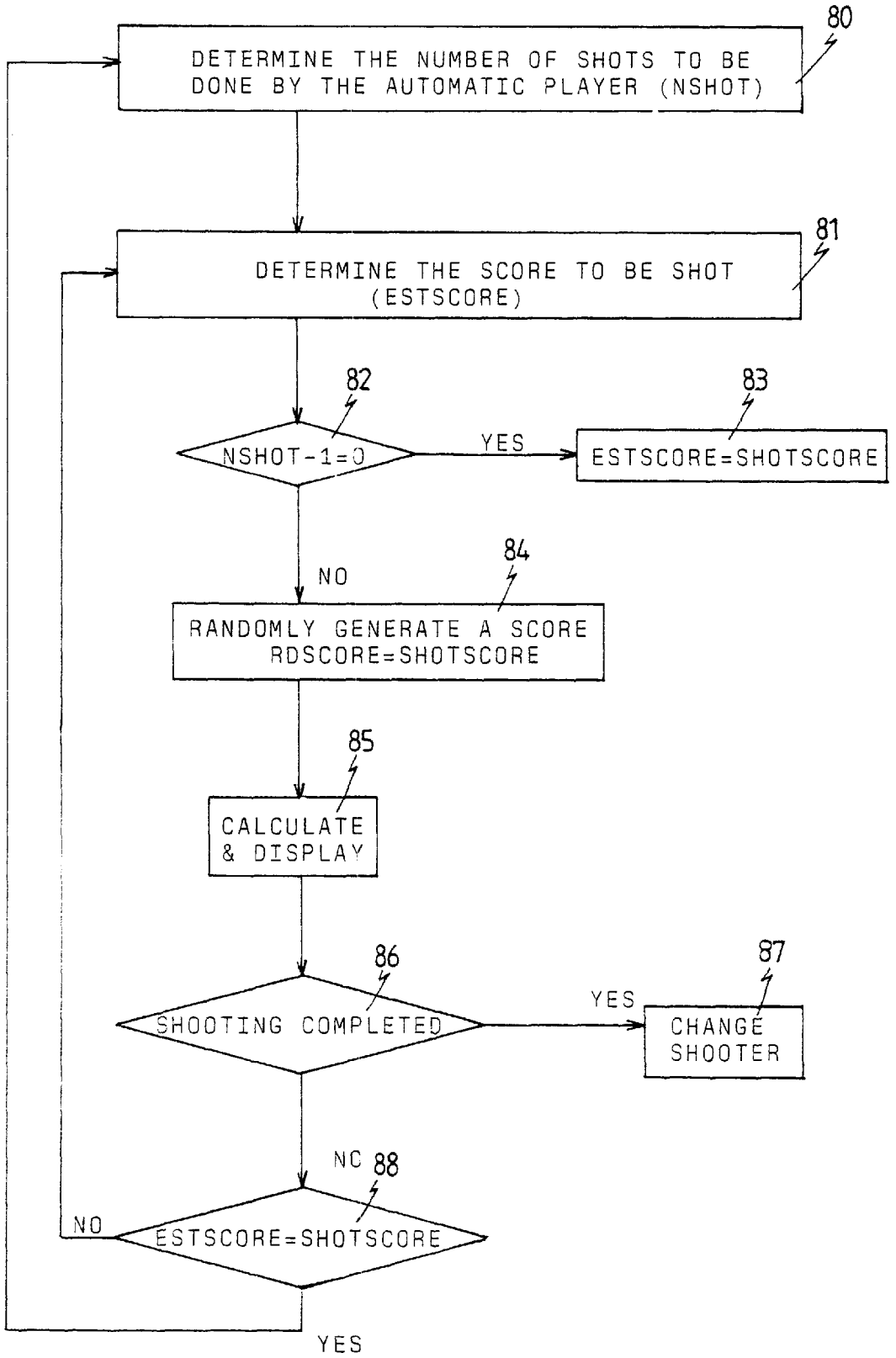
FIG. 4 is a flow chart illustrating the operation of the dart game.

Referring next to FIG. 4, a flow chart is shown and provided for illustrating the reasonings of the control device 15 for determining or generating the scores to be shot by the automatic player. The games to be played with may first be determined and selected by actuating the selecting device 3 (FIG. 3) by the user with one of the buttons 2. When the antomatic player determining device 4 is actuated in order to select or to actuate the automatic player, the user may first use one of the buttons 2 (FIG. 1) to actuate the function selecting device 5 (FIG. 3) in order to actuate the control device 15 or the processing unit and to determine the grade or the playing ability of the automatic player. For example, the control device 15 may first determine the number of shots to be done by the automatic player (NSHOT) 80. The NSHOT may be selected from 1, 2, 3 or any of the natural numbers. When NSHOT=1, it means that the control device 15 may shoot the estimated score in one shot. When NSHOT=2, it means that the control device 15 may shoot the estimated score in two shot; i.e., the chances for the control device 15 to shoot the estimated score will be 50%. When NSHOT=3, it means that the control device 15 may shoot the estimated score in three shot; i.e., the chances for the control device 15 to shoot the estimated score will be 33.3%. When the user is an excellent dart shooter, the user may select NSHOT=1. The user may also select NSHOT=5 (20%) when the user is a beginner.

The control device 15 may then determine the score to be shot (ESTSCORE) 81 by the automatic player in order to finish the game as quick as possible. For example, when the game is a count down game or is a cricket game, the largest number of score will be first selected, such as triple twenty (=60). When the score is about to be finished or shot, for example, when a score of 21 is left to be shot, the control device 15 may choose to shoot triple 7 in order to finish the game. When the ESTSCORE is determined (triple 20 for example), the control device 15 may determine whether NSHOT-1=0 or not 82. When NSHOT=1 or NSHOT-1=0, the automatic player is selected to be the highest grade, and ESTSCORE will be determined as the score shot by the automatic player (SHOTSCORE); i.e., the score shot by the automatic player is the estimated score, ESTSCORE=SHOTSCORE 83. If NSHOT-1 is not equals to 0 (the automatic player is not selected to be the highest grade), then the control device may randomly generate a score (RDSCORE) and let the radomly generated score RDSCORE=SHOTSCORE 84. The RDSCORE may also have a chance to be equal to the ESTSCORE. After the excellent shot 83 and the random shot 84, the control device 15 may then calculate the score of the automatic player and/or may display the score shot by the automatic player in the displayer 12 or 18 (85). The control device 15 will then determine whether the autmoatic player has finished all three shots or not 86. When the autmoatic player finishes all three shots, the control device 15 may then move to change shooter 87 for allowing the user to shoot after the automatic player. When the autmoatic player has finished all three shots, the control device 15 may determine whether ESTSCORE equals to SHOTSCORE or not 88. If ESTSCORE=SHOTSCORE, it means that the automatic player has a nice shot, then the user may has another chance to determine the grade or the playing ability of the automatic player or to determine the number of shots to be done by the automatic player 80. If ESTSCORE does not eqyals to SHOTSCORE, then the control device 15 may determine the score to be shot 81 (for the second or the third shot).

It is to be noted that the grade or the playing ability of the automatic player may also be determined by the control device 15 itself instead of being determined by the user. The score to be shot (ESTSCORE) may also be determined by the user with the buttons 2. The automatic player determining device 4 and the function selecting device 5 may also be designed to be actuated or determined by a single button 2. The user and the automatic player may also each shoot one shot alternatively instead of three shots each.

Accordingly, the dart game in accordance with the present invention includes a control device which may randomly generate a competing score for simulating a player to play with the user.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A dart game comprising:

a dart board including a score area and a number of dart segments slidably engaged in said score area for being shot by a dart and by a user, said dart segments each representing a predetermined score, means for detecting a shot of said dart segments shot by the dart, means for displaying a score of said dart segments shot by the dart, and means for generating an automatic score in competing with the score of said dart segments shot by the dart.

2. The dart game according to claim 1 further comprising means for selecting a game to be played with.

3. The dart game according to claim 1 further comprising means for selecting a grade of said means for generating said automatic score.

4. A dart game comprising:

a dart board including a score area and a number of dart segments slidably engaged in said score area for being shot by a dart and by a user, said dart segments each representing a predetermined score, means for detecting a shot of said dart segments shot by the dart, means for displaying a score of said dart segments shot by the dart, and means for randomly generating a score in competing with the score of said dart segments shot by the dart.

* * * * *